US007375687B2

(12) United States Patent
Ke et al.

(10) Patent No.: US 7,375,687 B2
(45) Date of Patent: May 20, 2008

(54) MONOPOLE ANTENNA

(75) Inventors: Yun-Long Ke, Tu-Cheng (TW); Lung-Sheng Tai, Tu-Cheng (TW); Yao-Shien Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/605,686

(22) Filed: Nov. 28, 2006

(65) Prior Publication Data

US 2007/0120743 A1 May 31, 2007

(30) Foreign Application Priority Data

Nov. 28, 2005 (TW) ..... 94141660 A

(51) Int. Cl.
*H01Q 1/38* (2006.01)

(52) U.S. Cl. ..... 343/700 MS; 343/767; 343/846

(58) Field of Classification Search ..... 343/700 MS, 343/846, 767
See application file for complete search history.

(56) References Cited

U.S. PATENT DOCUMENTS

| | | | | |
|---|---|---|---|---|
| 6,603,429 | B1 * | 8/2003 | Bancroft et al. | 343/700 MS |
| 6,864,842 | B2 * | 3/2005 | Hung et al. | 343/700 MS |
| 7,042,401 | B2 * | 5/2006 | Park et al. | 343/700 MS |
| 2005/0280580 | A1 * | 12/2005 | Lin | 343/700 MS |

FOREIGN PATENT DOCUMENTS

| | | |
|---|---|---|
| TW | 239677 | 9/2005 |

* cited by examiner

*Primary Examiner*—Hoang V Nguyen
(74) *Attorney, Agent, or Firm*—Wei Te Chung

(57) ABSTRACT

A monopole antenna comprises a planar substrate, a radiating element arranged on the planar substrate and of long-guide trapezium-shape and comprises a trapezium notch in the middle thereof, a grounding element assembled with said planar base with a predetermined angle.

15 Claims, 6 Drawing Sheets

MONOPOLE ANTENNA

BACKGROUND OF THE INVENTION

1. Field of the Invention

The present invention relates generally to a monopole antenna, and more particularly to a monopole antenna being used in an electronic device.

2. Description of the Prior Art

With the development of wireless communication, compact structure antennas are popular to be used in electronic devices. Several conventional compact structure antennas include multiple parts, usually occupying rekatively space, while the electronic device has compact structure. Thus, reducing the number of parts of antenna can significantly reduce the cost and suitable for used in the electronic device. TW Pat. No. 239677 describes a wide band monopole antenna. The monopole antenna comprises a grouding portion, a radiating portion located above the grouding portion and a feeder line. The grouding portion is rectangular and includes an up edge, a low edge, a grouding point and a short point. The radiating portion includes a first metal patch, a second metal patch and a short metal arm. The feeder line includes a center conductor and an external conductor. But the occupied space of the monopole antenna is too large to be assembled in an interior space of the electronic devices with compact structure.

Referring now to FIG. 1, a muti-band antenna 1' is shown and includes an insulative substrate 10', a first ground portion 20', a second ground portion 50', a low-frequency radiating portion 20', a high-frequency radiating portion 30', and a signal feeder cable 70'. The first ground portion 40', the low-frequency radiating portion 40', and the high-frequency radiating portion 30' are made of sheet metal and are arranged on an upper surface of the insulative substrate 10'. The second ground portion 50' is arranged on a lower surface of the insulative substrate 10' opposite to the first ground portion 40'. The signal feeder cable 70' comprises an inner core wire 71' and a metal braiding layer 72' respectively soldered onto the high-frequency radiating portion 30' and the first ground portion 40'. The high-frequency radiating portion 30' and the first ground portion 40' are configured to cooperately define a resonating space 60' therebetween. The low-frequency portion 20' of the muti-band antenna 1' is of trapezium shape and has difficulty to match impedance. The antenna with smaller size needs some special shape to achieve its impedance.

Hence, an improved antenna is desired to overcome the above-mentioned shortcomings of the existing antennas.

BRIEF SUMMARY OF THE INVENTION

A primary object, therefore, of the present invention is to provide a monopole antenna with smaller size and wide bandwidth.

In order to implement the above object and overcomes the above-identified deficiencies in the prior art, the monopole antenna comprising: a planar base; a radiating element is long-guide trapezium-shaped and includes notch in the middle thereof; a grounding element locates on said planar base with a determined angle; a feeder line includes a center conductor connecting with said radiating element and a external conductor connecting with said grounding element.

Other objects, advantages and novel features of the invention will become more apparent from the following detailed description of a preferred embodiment when taken in conjunction with the accompanying drawings.

DETAILED DESCRIPTION OF THE INVENTION

Figure 1:
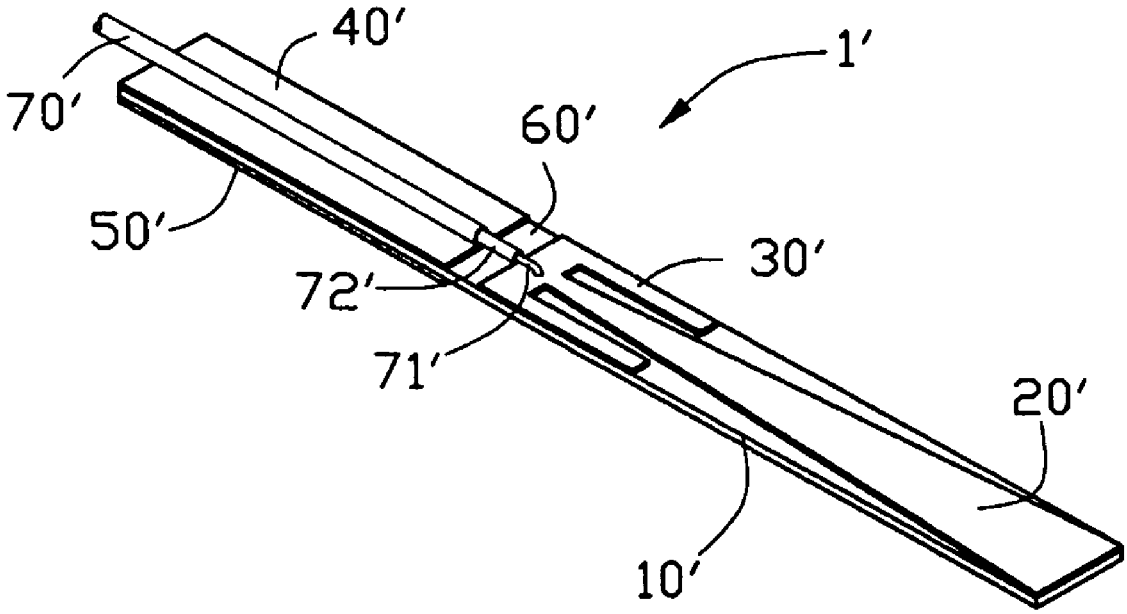
FIG. 1 is an assembled perspective view of a conventional multi-band antenna.
Figure 2:
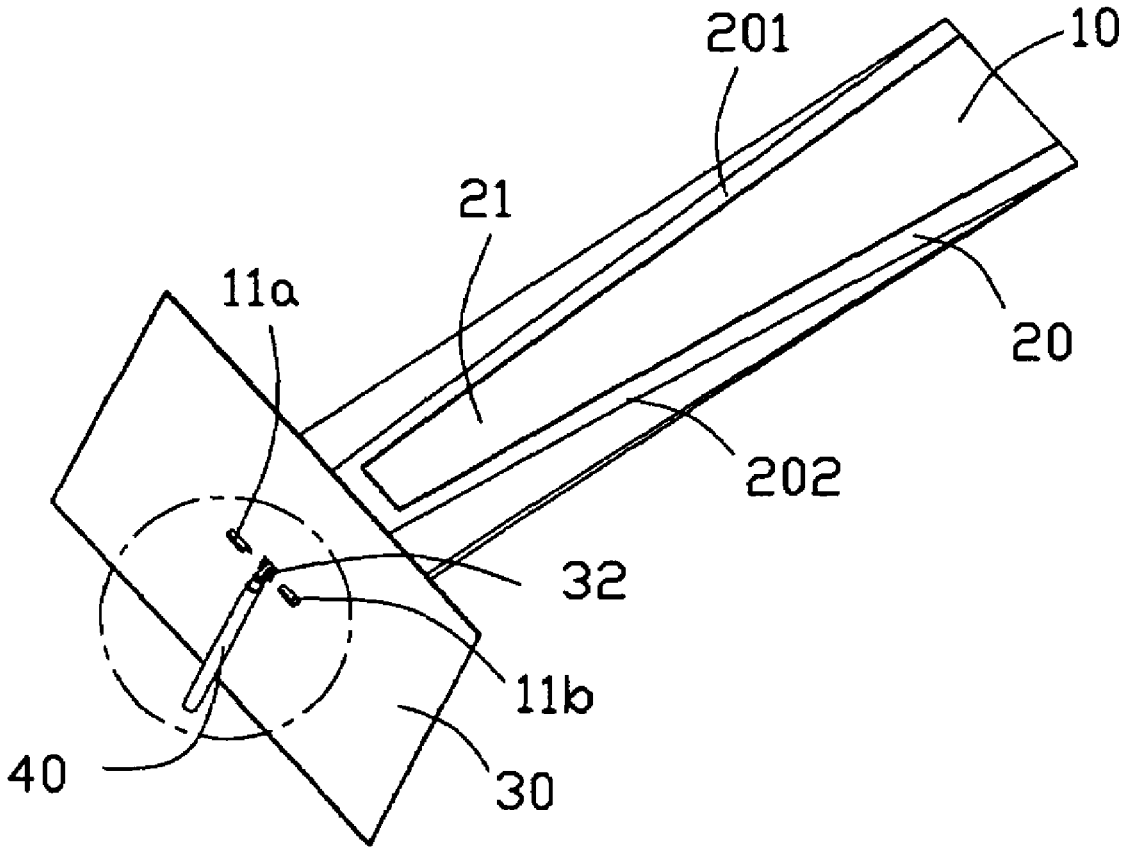
FIG. 2 is an assembled perspective view of a monopole antenna in accordance with the present invention.
Figure 3:
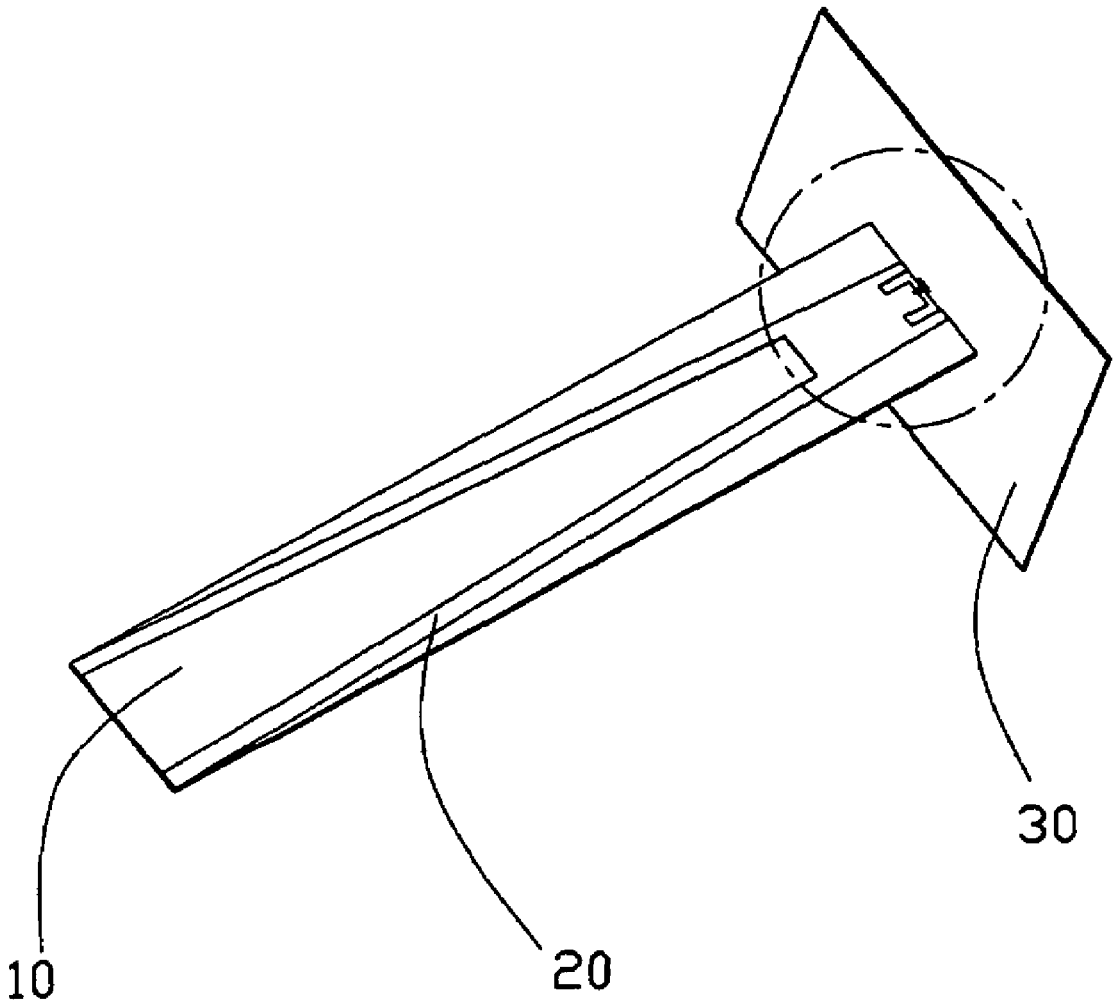
FIG. 3 is a view similar to FIG. 2 but take from a different aspect.
Figure 4:
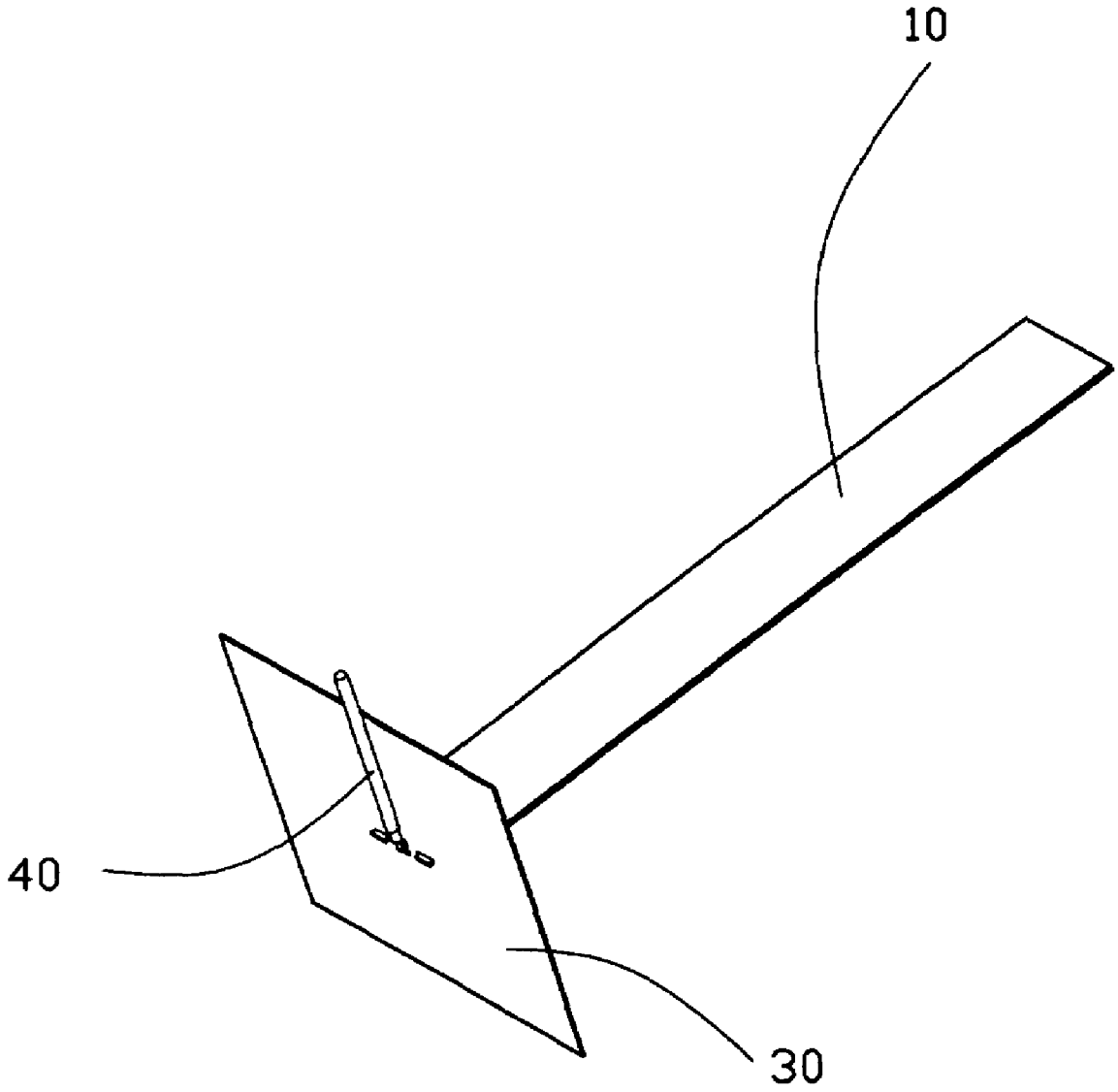
FIG. 4 is another view similar to FIG. 2 but take from another different aspect.
Figure 5:
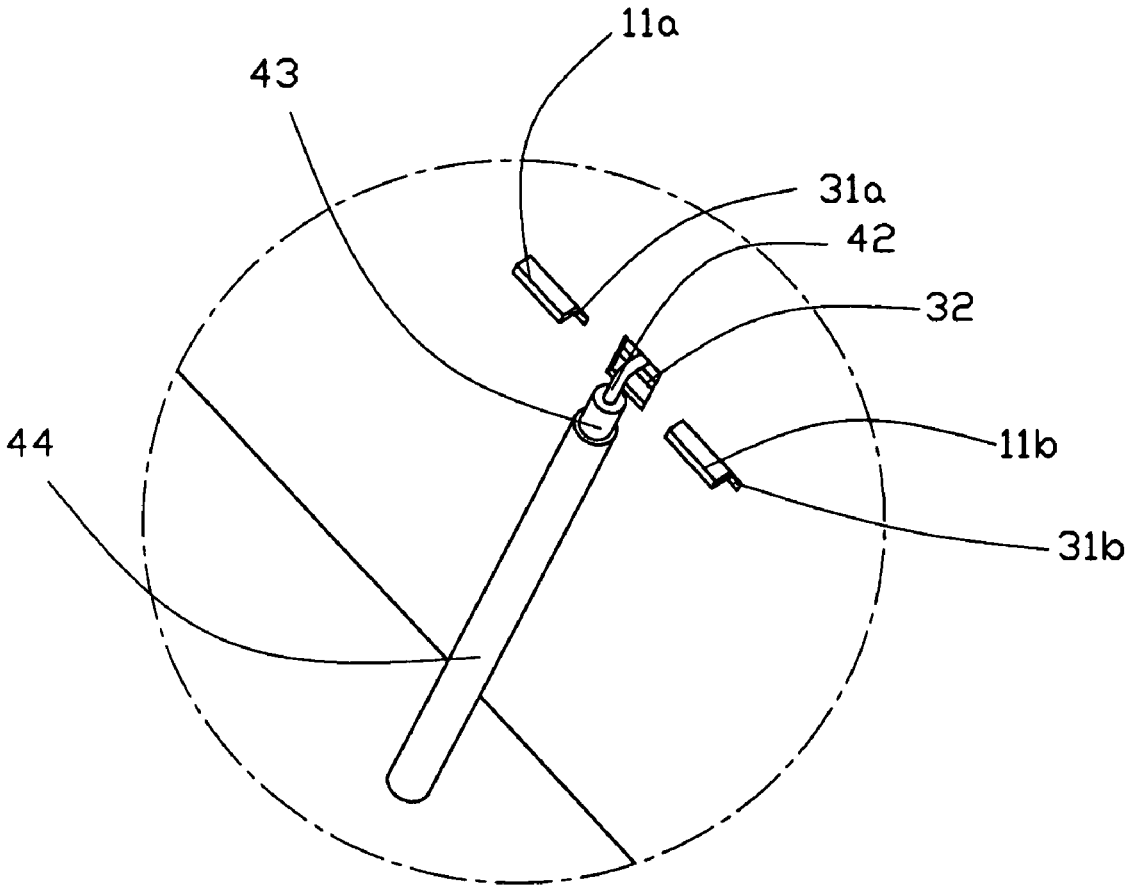
FIG. 5 is an enlarged view of the circled area of FIG. 2.

Reference will now be made in detail to a preferred embodiment of the present invention.

Referring to FIG. 2 to FIG. 6, a monopole antenna 1 according to the present invention is shown. The monopole antenna 1 comprises a planar substrate 10, a radiating element 20, a grounding element 30, and a feeder line 40. The radiating element 20 and the grounding element 30 are made of metal sheet and the radiating element 20 locates on the upper surface of the planar substrate 10.

Figure 6:
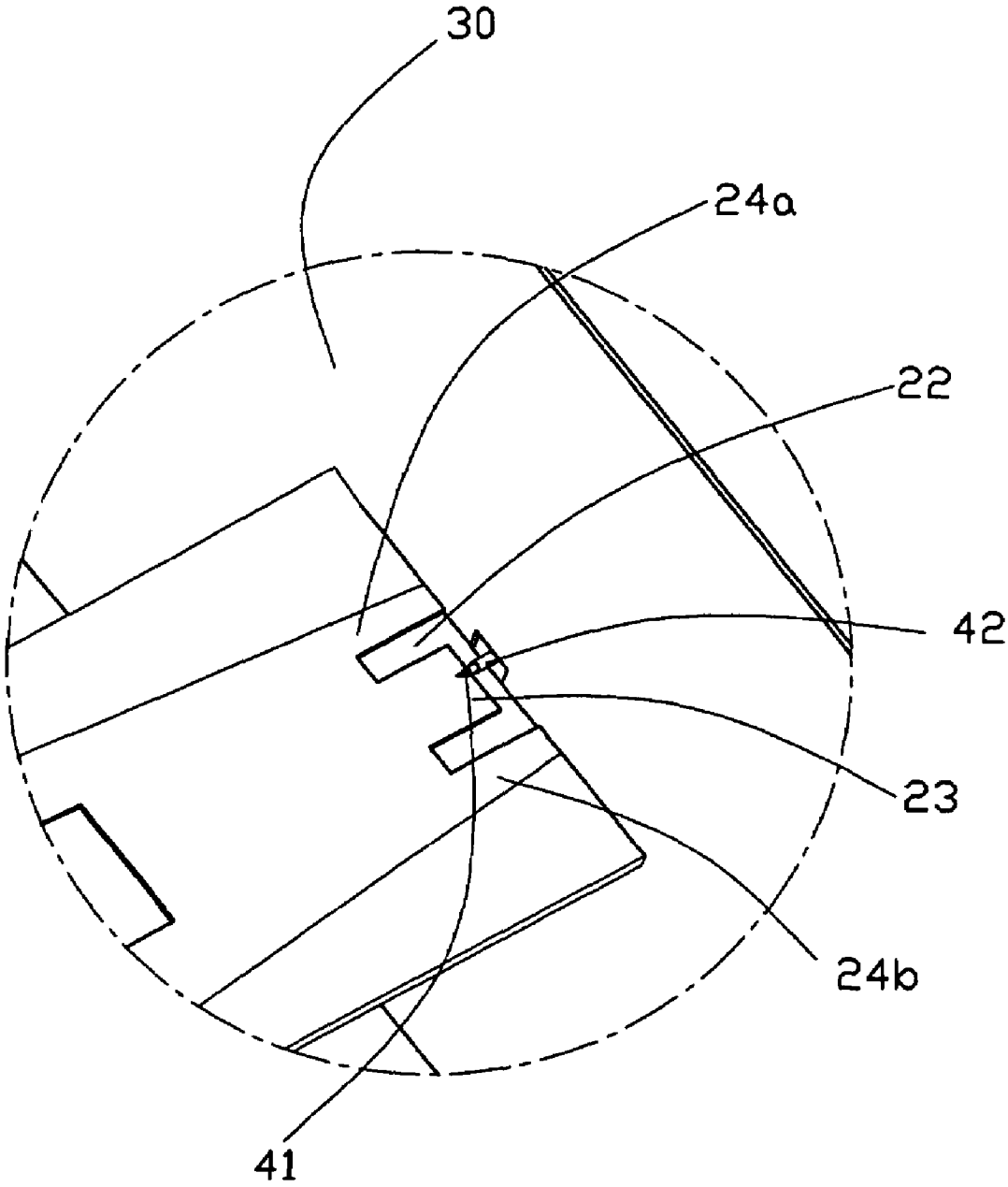
FIG. 6 is an enlarged view of the circled area of FIG. 3.

The radiating element 20 of long-guide trapezium-shape comprises a trapezium-shaped notch 21 in the middle of the metal sheet which divides the antenna 1 into a first radiating arm 201 and a second radiating arm 202. Referring to FIG. 6, 8the narrower end adjacent to grounding element 30 of the radiating element 20 comprises a U-shaped slot 22, resulting in the narrower end of the radiating element 20 forming a first rectangular arm 24*a*, a second rectangular arm 24*b* and a protruding portion 23. the radiating element 20 is plastered on the planar substrate 10.

The grouding element 30 of rectangle-shaped is arranged substantially perpendicular to the planar substrate 10 and comprises a cutout 32 forming symmetrical rectangle-shaped grooves 31*a*, 31*b* on the both sides of the cutout in the middle thereof.

The feeder line 40 is a coaxial cable, and includes an inner conductor 41, an inner insulator 42 surrounding the inner conductor 41, a braid layer 43 surrounding the inner insulator 42, and an outer insulator 44 surrounding the braid layer 43. A front end of the inner insulator 42 is stripped to expose front end of the inner conductor 41. The inner conductor 41 is connected with the protruding portion 23 and the braid layer 43 extends through the cutout 32 to be connected with the grounding element 30.

The planar substrate 10 forms a pair of heaves 11*a*, 11*b* extending from the underside thereof. In assembly the heaves 11*a*, 11*b* respectively extend through the grooves 31*a*, 31*b*, so as to attach itself on the grouding element 30 firmly.

The data of the experiment of the monopole antenna 1 achieves enough band width. The monopole antenna 1 uses the special figure of trapezium with the notch 21 to improve its impedance matching. The monopole antenna 1 can gain enough band with.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A monopole antenna, comprising:

a planar substrate;

a radiating element arranged on the planar substrate and of long-guide trapezium-shape and comprises a trapezium notch in the middle thereof;

a grounding element assembled with said planar substrate with a predetermined angle;

a feeder line comprises an inner conductor connecting with said radiating element and a outer conductor connecting with said grounding element.

2. The monopole antenna as claimed in claim 1, wherein said grounding element is arranged to be perpendicular to said planar substrate.

3. The monopole antenna as claimed in claim 1, wherein said planar substrate comprises two heaves extending from the underside of said planar substrate.

4. The monopole antenna as claimed in claim 3, wherein said grounding element is rectangular-shape metal slice and form a cutout in the middle thereof.

5. The monopole antenna as claimed in claim 4, wherein said grounding element forms rectangle grooves cooperating to said heaves on the both sides of said cutout and keeps clear of said cutout.

6. The monopole antenna as claimed in claim 1, wherein said radiating element forms a narrower portion adjacent to said grounding element and said notch is trapezium-shaped.

7. The monopole antenna as claimed in claim 4, wherein said radiating element forms a U-shaped slot on the narrower portion.

8. The monopole antenna as claimed in claim 4, wherein said narrower portion of the radiating element comprises a protruding portion, a first rectangle arm and a second rectangular arm, and all of said protruding portion, said first rectangular arm, and said second rectangular arm compose of a U-shaped slot.

9. The monopole antenna as claimed in claim 1, wherein said radiating element is divided into a first radiating arm and a second radiating arm by the notch.

10. The monopole antenna as claimed in claim 1, wherein said inner conductor of said feeder line is connected with said protruding portion and the outer conductor extending through the cutout to conductor with the grounding element.

11. A monopole antenna, comprising:

a planar substrate;

a radiating element arranged on the planar substrate and of long-guide trapezium-shape;

a grounding element assembled with said planar base with a predetermined angle;

a feeder line comprises an inner conductor connecting with said radiating element and a outer conductor connecting with said grounding element.

12. The monopole antenna as claimed in claim 11, wherein the feeder line and the radiating element are respectively located on two opposite surface of the grounding element.

13. The monopole antenna as claimed in claim 12, wherein a portion of said trapezium-shape is removed to achieve a desired impedance.

14. The monopole antenna as claimed in claim 11, wherein a U-shaped slot is formed in the radiating element adjacent to an intersection region of the radiating element and the grounding element.

15. A monopole antenna, comprising:

a planar substrate;

a radiating element arranged on the planar substrate and of long-guide trapezium-shape and comprises a trapezium notch in the middle thereof;

a grounding element applied to said planar base;

a feeder line comprises an inner conductor connecting with said radiating element and a outer conductor connecting with said grounding element; wherein a U-shaped slot is formed in a region of the radiating element where is closest to the grounding element than any other regions of the radiating element.

* * * * *